US007845518B2

(12) United States Patent
Lasserre et al.

(10) Patent No.: US 7,845,518 B2
(45) Date of Patent: Dec. 7, 2010

(54) PRODUCT PACKAGING AND DISPENSING ASSEMBLY

(75) Inventors: Pierre-Andre Lasserre, Coubron (FR); Marcel Sanchez, Paris (FR)

(73) Assignee: L'Oreal, Paris (FR)

( * ) Notice: Subject to any disclaimer, the term of this patent is extended or adjusted under 35 U.S.C. 154(b) by 1096 days.

(21) Appl. No.: 11/509,560

(22) Filed: Aug. 25, 2006

(65) Prior Publication Data

US 2007/0045343 A1 Mar. 1, 2007

Related U.S. Application Data

(60) Provisional application No. 60/713,759, filed on Sep. 6, 2005.

(30) Foreign Application Priority Data

Aug. 25, 2005 (FR) ..... 05 52565

(51) Int. Cl.
*B67D 7/70* (2010.01)

(52) U.S. Cl. ..... 222/135; 222/402.13; 222/402.21; 401/47

(58) Field of Classification Search ..... 222/135, 222/402.11, 402.13, 402.15, 402.21, 529; 401/47; 251/354, 353
See application file for complete search history.

(56) References Cited

U.S. PATENT DOCUMENTS 3,018,929 A * 1/1962 Obst ..... 222/402.21
3,540,634 A * 11/1970 Mayercik ..... 222/402.21
3,618,827 A 11/1971 Melocchi
3,658,294 A * 4/1972 Ewald ..... 251/354
4,157,774 A * 6/1979 Micallef ..... 222/321.9
4,328,911 A * 5/1982 Knickerbocker ..... 222/182
4,426,026 A * 1/1984 Knickerbocker ..... 222/402.13
5,018,647 A * 5/1991 Abplanalf ..... 222/108
2007/0034653 A1 * 2/2007 Strand ..... 222/402.13

FOREIGN PATENT DOCUMENTS

| | | |
|---|---|---|
| EP | 0 734 781 | 10/1996 |
| FR | 2 732 245 | 10/1996 |
| JP | 2004-154459 | 6/2004 |

OTHER PUBLICATIONS

Suzuki Hideya, JP 2004-154459 translation.*
U.S. Appl. No. 11/509581, filed Aug. 25, 2006, Lasserre et al.

* cited by examiner

*Primary Examiner*—Kenneth Bomberg
*Assistant Examiner*—Robert K Nichols, II
(74) *Attorney, Agent, or Firm*—Oblon, Spivak, McClelland, Maier & Neustadt, L.L.P.

(57) ABSTRACT

A product packaging and dispensing assembly includes one or more containers containing a product. The assembly includes a dispensing device which is movable relative to the container in a swiveling or rocking motion to actuate an actuator rod of the container. In addition, an arrangement is provided which limits displacement of the dispensing device to prevent or minimize movement of the dispensing device in the direction of the longitudinal axis of the actuator rod, and also to limit swiveling movement in a direction opposite to that utilized for actuation of the actuator rod.

37 Claims, 4 Drawing Sheets

PRODUCT PACKAGING AND DISPENSING ASSEMBLY

CROSS-REFERENCE TO RELATED APPLICATIONS

This document claims priority to French Application Number 05 52565, filed Aug. 25, 2005 and U.S. Provisional Application No. 60/713,759, filed Sep. 6, 2005, the entire content of which are hereby incorporated by reference.

FIELD OF THE INVENTION

The present invention relates to a product packaging and dispensing assembly. The assembly can be particularly advantageous for cosmetics. Such a product may be dispensed, for example, in the form of a cream, a gel, a foam or a spray.

BACKGROUND OF THE INVENTION

Discussion of Background

A cosmetic product is a product as defined in Directive 93/35/EEC by the Council of 14 Jun. 1993, modifying for the sixth time Directive 76/768/EEC.

In general, a packaging and dispensing assembly as specified by the present invention includes a container containing the product to be dispensed and fitted with a dispensing element. Such a dispensing element may be a pump or a valve mounted on a dispensing device. The dispensing device allows the user to guide or direct the flow of the product emerging from the container towards a dispensing opening. The dispensing device can also allow control of the actuation of the dispensing element to eject a dose of the product from the container.

Certain dispensing devices are also provided to allow separate or mixed dispensing of two products stored separately in two containers.

French patent application FR-A-2 732 245 discloses a dispensing device including a body and a push-button which is movable relative to the body to provide a simultaneous or separate dispensing of two products from two containers in which the products are stored separately. Each container is fitted with a valve including a hollow actuator rod, depression of which causes dispensing of the product.

Devices for dispensing one or more products are generally pressed onto the actuator rod(s) of the valve or pump so firmly that during assembly of the dispensing device on the container(s), the actuator rod can be pressed and hence activated. Product can then undesirably emerge from the container.

JP2004-154459 also describes an assembly of the same type as those described above in which the push-button is hooked to a hoop that is itself fixed to the containers so as to be able to pivot relative to the hoop and to the containers in order to actuate the valves. The push-button can pivot in both directions in relation to its rest position.

U.S. Pat. No. 3,618,827 describes a packaging and dispensing assembly including a container mounted over a dispensing device. A hemispherical hood covers the dispensing device. The hood includes a fixed part and a pivoting part which, once swiveled, exposes the dispensing opening. When swiveled, the pivoting part also comes to rest on the dispensing device, swiveling it to actuate the valve.

There is a need for an assembly which limits the accidental dispensing of the products.

There is also a need for a dispensing assembly which can easily be actuated.

There is also a need for an assembly which minimizes oxidation of the products to be dispensed.

There is also a need for a dispensing assembly which can dispense two products from two containers in the same proportions on each actuation.

SUMMARY OF THE INVENTION

According to the invention the above objects can be achieved by a product packaging and dispensing assembly. A preferred example of such an assembly includes at least one container containing a product, with the container fitted with a dispensing element that includes an actuator rod. A dispensing device is movable relative to the container in order to actuate the dispensing element and allow the output of the product through at least one dispensing opening. The assembly also includes an arrangement for limiting the displacement of the dispensing device. According to an example, such an arrangement includes at least one flap able to come to rest against a surface transverse to the longitudinal axis of the actuator rod on depression of the dispensing device along this axis so as to prevent the dispensing device from moving the actuator rod along its longitudinal axis. Preferably, the arrangement is also configured to allow the dispensing device to swivel the actuator rod about a swivel axis in a first direction from a rest position of the rod, and to prevent it from swiveling the actuator rod about the swivel axis in the direction opposite the first direction from the rest position.

The provision of an arrangement for limiting the displacement of the dispensing device prevents the actuator rod from being depressed along its longitudinal axis, for example during assembly of the device on the container. In addition, or alternatively, the dispensing device can be removably fixed on the container so that, for example, the user can remove it for cleaning and replace it on the container without undesired escape or discharge of the product. The arrangement for limiting displacement of the dispensing device also allows guiding of the user's actions during dispensing of the product. For example, the arrangement can allow the rod to swivel only in one direction in relation to its rest position.

In addition, since the actuator rod is actuated by swiveling or rocking, it therefore requires little force for actuation, providing comfort or ease of use. The product can emerge from the actuator rod with a minimal or small amount of swiveling movement.

The flap can extend parallel to the longitudinal axis of the rod, for example, inside the dispensing device from an upper surface to a free edge forming a stop.

By way of example, the free edge of the flap can include a straight portion coming to rest on the transverse surface, with the straight portion extending to a rounded portion located at a distance from the transverse surface measured along the longitudinal axis of the rod. The rounded portion thus allows the swiveling or rocking of the dispensing device.

Further by way of example, the assembly can also include a guide arrangement configured so as to allow the swiveling of the dispensing device only about the swivel axis. The guide arrangement, for example, can include a rail situated opposite the flap. The free edge of the flap can be engaged in the rail in the rest position. As a variant, the free edge of the flap can be engaged in the rail once the swiveling of the actuator device has begun.

The assembly can also include a fixing element serving to fix the dispensing device on the container. The fixing element can include an assembly skirt which can be mounted in place on the container either directly on top or on a cup itself fixed, for example, by clamping to the neck of the container.

Also by way of example, the dispensing device can include a hook arrangement to hook the device to the fixing element. The hook arrangement can include at least one hook which cooperates with at least one shaft so as to be able to pivot about the shaft and allow swiveling of the dispensing device about the swivel axis. Preferably, the hook arrangement includes two hooks which cooperate respectively with two shafts, with the two hooks and the two shafts being respectively aligned along a line parallel to the swivel axis. The swiveling is therefore more stable. With this example, the dispensing device can be mounted on the assembly element using the hook and these two parts can be supplied assembled to the container filling line. Only one assembly operation is then required after filling of the container.

The dispensing device can include at least one sleeve able to be engaged on the actuator rod of the container to allow the interior of the container to communicate with the dispensing opening.

According to one embodiment or example, the assembly can include two containers. The dispensing device can be arranged to channel the products separately to two dispensing openings. According to this embodiment, the dispensing device includes two separate channels to guide the product from each container to each dispensing opening. This embodiment is particularly advantageous for distributing products which are not stable over time when in contact with each other and which should or must be brought into contact with each other as late as possible, or in which it is desirable to bring the products into contact shortly before use.

As a variant, the dispensing device can be arranged to allow mixing of the products before the latter reach the dispensing opening.

The assembly can also include a cover to protect the dispensing device.

The container(s) can be pressurised. The dispensing element can then be a valve.

The container(s) can contain a cosmetic product, for example a hair coloring product. For example, one of the containers can contain a dye and the other container can contain an oxidizing agent.

As should be apparent, the invention can provide a number of advantageous features and benefits. It is to be understood that, in practicing the invention, an embodiment can be constructed to include one ore more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
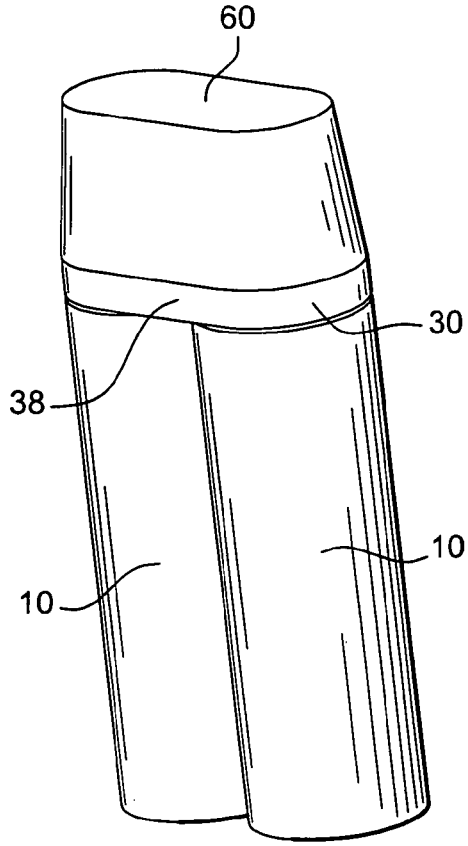
FIG. 1 is a perspective view of a packaging and dispensing assembly according to the invention.

Referring now to the drawings, like reference numerals are utilized to designate identical or corresponding parts throughout the several views.

Figure 2:
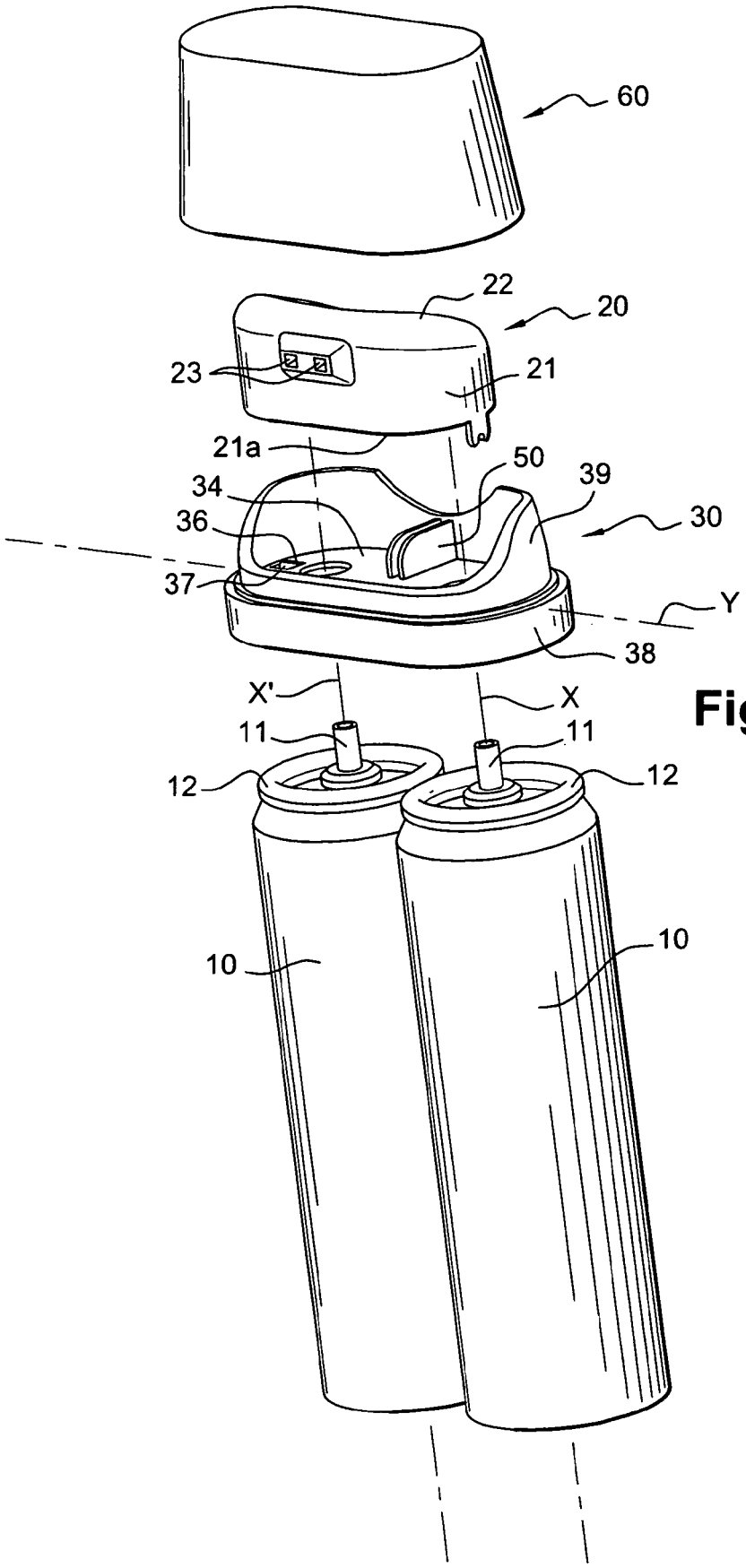
FIG. 2 is an exploded view of the assembly in FIG. 1.
Figure 5:
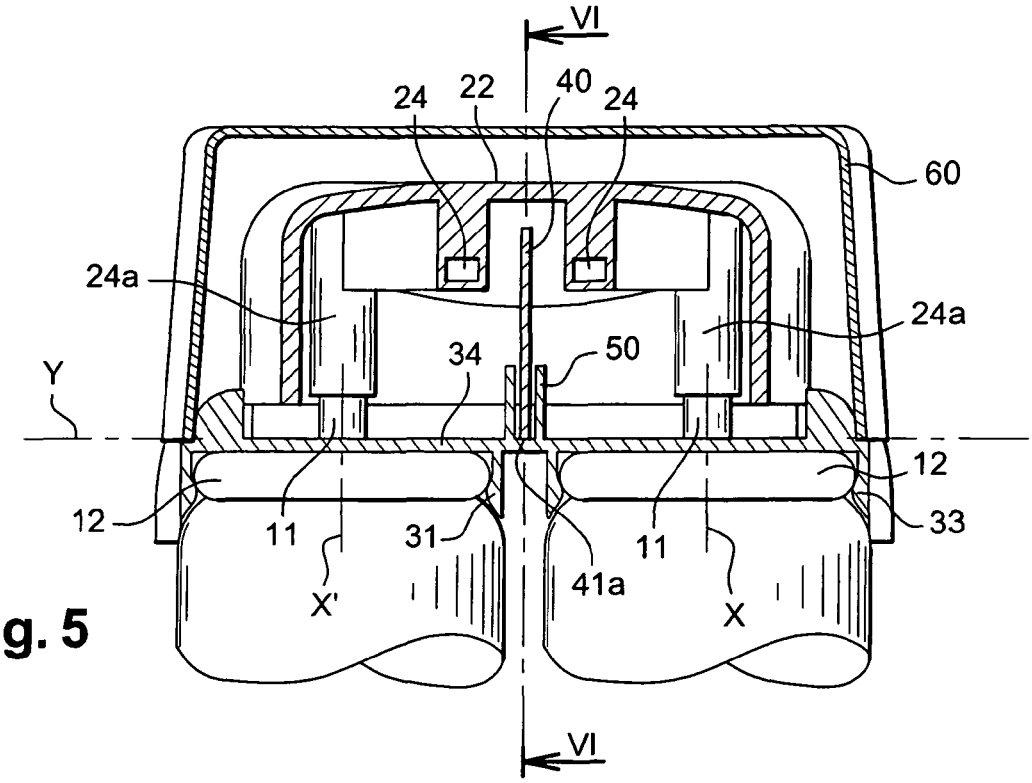
FIG. 5 is diagrammatically and partly, in axial cross-section, the packaging and application assembly according to the invention.
Figure 6:
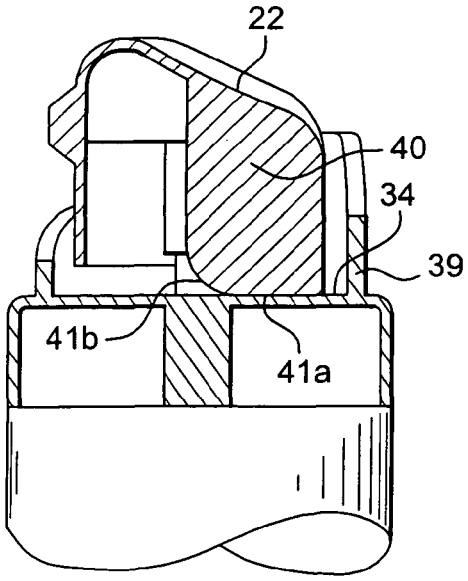
FIG. 6 is a cross-section of FIG. 5 along line VI-VI.
Figure 7:
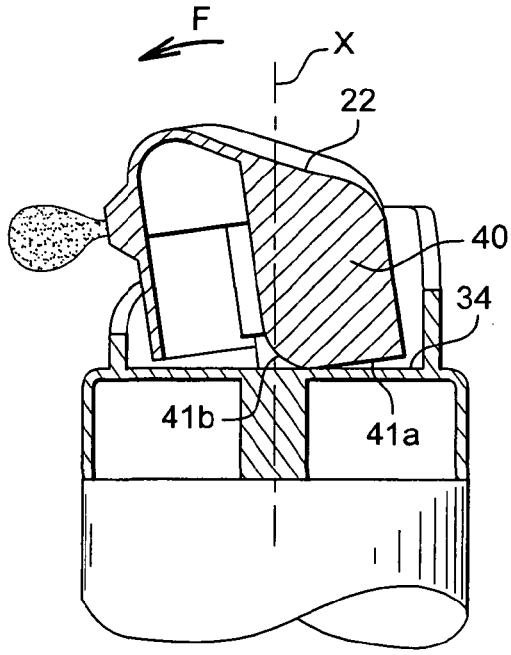
FIG. 7 is a cross-section identical to that in FIG. 6 while the device is being used.

FIGS. 1 and 2 show an example of a dispensing assembly that includes a dispensing device 20 mounted on two containers 10 containing products for extemporaneous mixing.

For example, the containers can be particularly advantageous for containing cosmetic products, and in a particular example hair coloring products. One container 10 contains, for example, a dye and the other container 10 contains an oxidizing agent.

In the example embodiment illustrated, each container 10 is of the pressurised aerosol type and includes a valve with an actuator rod 11 having a longitudinal axis X and X' as shown in FIG. 2. The valve is held by clamping on a cup 12 crimped to the container.

The actuator rod 11 is hollow and the product is distributed through this actuator rod when the actuator rod is swiveled or rocked.

By way of example, the dispensing device 20 is fixed on the containers by a fixing element 30. The dispensing device 20 is fixed or mounted so that it can cause the actuator rods to swivel. In particular, the dispensing device 20 is movable in relation to the fixing element 30 so as to control the actuation of the valve rods.

Figure 4:
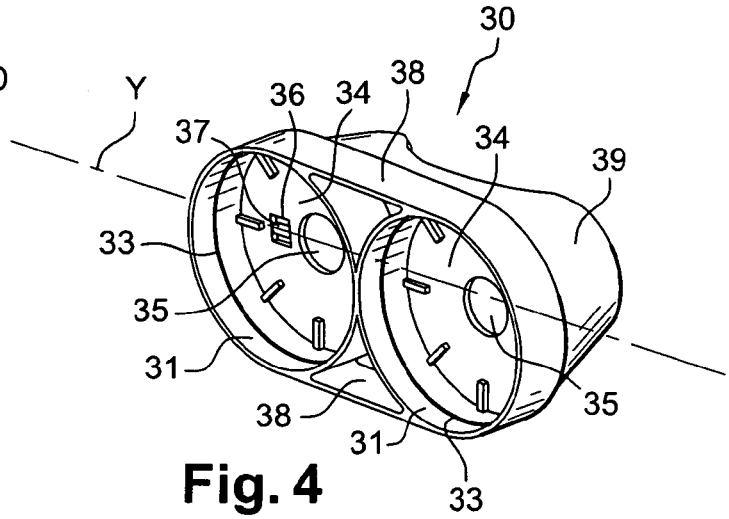
FIG. 4 is an element for fixing the dispensing device on the containers.

The fixing element 30 shown in the example of FIG. 4 includes two tubular mounting skirts 31 of circular cross section which hook by engagement below the cup or flange 12 of the corresponding container. To this end, an annular strip 33 is provided on the radially inner surface of each skirt that comes to rest below each cup or flange.

The two assembly skirts 31 are attached to each other so as to be as close as possible to the containers and limit the space of the packaging assembly. The mounting skirts 31 are also joined together by a transverse wall 34 which extends above each skirt 31. Through the transverse wall 34 there are two circular passages 35, each concentric to a mounting skirt 31, with each of the passages 35 being designed to receive the upper end of one of the containers 10. The two circular passages 35 are aligned along an axis Y. Where the assembly does not include such a fixing element, a transverse wall can alternately be provided on the container or containers.

Two openings 36 are also provided close to each passage 35 along axis Y outside passages 35. In the example shown, each opening 36 is square in shape, but other shapes or forms could be used. Through each opening 36 a shaft 37 passes, the function of which will be explained later herein. The shaft 37 extends along axis Y and includes a circular section transverse to this axis Y in the illustrated example.

The two skirts 31 are also connected at their periphery by two straight walls 38 extending, for example, parallel to axis Y so as to form an oval external wall.

In this example, above the transverse wall 34, a peripheral shoulder 39 extends to the periphery of wall 34 over just part of its circumference. In particular, the peripheral shoulder 39 surrounds or extends along the two rounded ends of the transverse wall 34 and one of its straight edges 38, the second straight edge 38, has no shoulder. The function of this shoulder will be explained in the description below.

Figure 3:
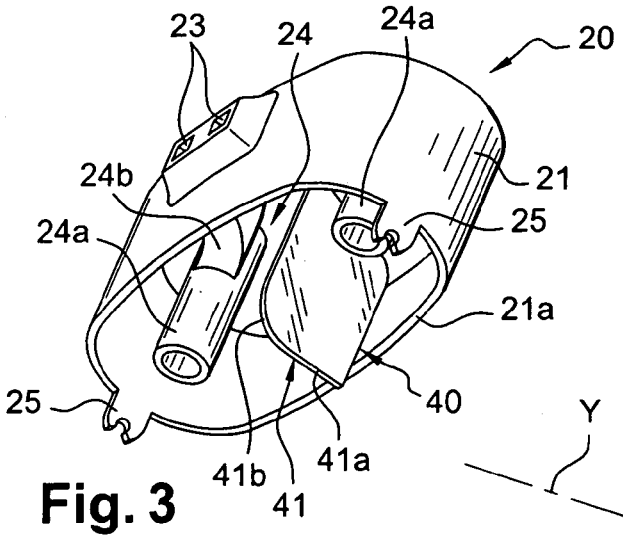
FIG. 3 is the dispensing device of the assembly shown in FIGS. 1 and 2.

The dispensing device 20 is illustrated in more detail in FIG. 3. By way of example, the device 20 includes an external shell 21, the upper part of which is rounded and forms an actuator surface 22. The shell 21 terminates in its lower part in a free edge 21*a*.

The dispensing device 20 is also arranged to channel the products separately from the containers to two dispensing openings 23. To this end, two separate pipes or channels 24 are provided inside the shell 21, which each include a vertical sleeve 24*a* intended to sit closely over the actuator rods, sealed against the product. Each sleeve is extended by a horizontal or transverse portion 24*b* which opens via a dispensing opening 23. The two horizontal portions 24*b* converge towards each other such that the two dispensing orifices 23 are approximately adjacent. The ends of the pipe or channel portions 24*b* preferably pass through the shell 21 such that the openings 23 project over the outer envelope of the shell forming a nozzle.

In a variant not shown, the two pipes or channels 24 can be connected before their end so as to allow mixing of the products before the latter reach the dispensing opening. With this example, only one exit or discharge opening need be provided.

In the illustrated example, the dispensing device 20 is advantageously coupled to the fixing element 30 by hooks 25 provided on the free edge 21*a* of the shell at each rounded end. The two hooks 25 are aligned along axis Y to form a swivel axis. Each hook 25 is configured to hook onto the corresponding shaft 37 while being able to pivot about the shaft to allow swiveling of the dispensing device relative to the hooking element, about axis Y.

In a variant not shown, the dispensing device 20 need not be hooked to the fixing element. No hook or corresponding shaft is then required. For example, the dispensing device can be held in place in the packaging and dispensing assembly simply by sitting closely over the actuator rods so that sleeves of the dispensing device hold the device on the actuator rods.

In the mounted position of the dispensing device 20, the peripheral shoulder 39 of the fixing element protects the dispensing device, in particular by surrounding its base. The straight edge 38 of the transverse wall of the fixing element, which has no shoulder, is next to the dispensing openings 23, namely towards the front of the dispensing device, so as to allow swiveling or rocking of the device 20 forwards. The shoulder 39 ensures that only the actuating surface 22 then protrudes.

An arrangement of one or more elements 40 is also preferably provided to limit the displacement of the dispensing device. In particular, the element 40 is configured to prevent or limit the dispensing device 20 from moving the actuator rods 11 parallel to their longitudinal axis X and X' while allowing the dispensing device 20 to swivel the actuator rods along a direction F from their rest position. In the illustrated example, the element 40 is located between the two containers so as to prevent depression of both of the two valve rods.

By way of example, the element 40 can include a flap 40 provided on the dispensing device. The flap 40 extends inside the shell 21 from the inner face of the actuator surface 22 to a free edge 41 forming a stop. The flap comprises a wall parallel to the longitudinal axes X and X' of the actuator rods. The free end 41 of the flap 40 includes a straight portion 41*a* arranged, once the movable element is attached to or mounted on the fixing element, so as to be close to the transverse wall 34 of the fixing element. Thus, as soon as an attempt is made to depress the dispensing device 20 parallel to axes X and X' of the actuator rods, the straight portion 41*a* of the free edge of the flap comes to stop or abut against the transverse wall 34.

In the illustrated example, the free edge of the flap includes a rounded portion 41*b* at the front, which is remote from the transverse wall 21*a* and which thus allows the swiveling of the dispensing device about axis Y towards the front in a direction F from the rest position of the actuator rods. Advantageously, the flap 40 is formed behind the shell on the opposite side to the dispensing openings 23 and does not extend over the entire width of the shell. The flap is thus positioned and has a shape such that it prevents swiveling to the back opposite to direction F from the rest position of the dispensing device. This prevents the user from actuating the actuator rods so as to orientate the dispensing openings towards the top of the device.

Figure 8:
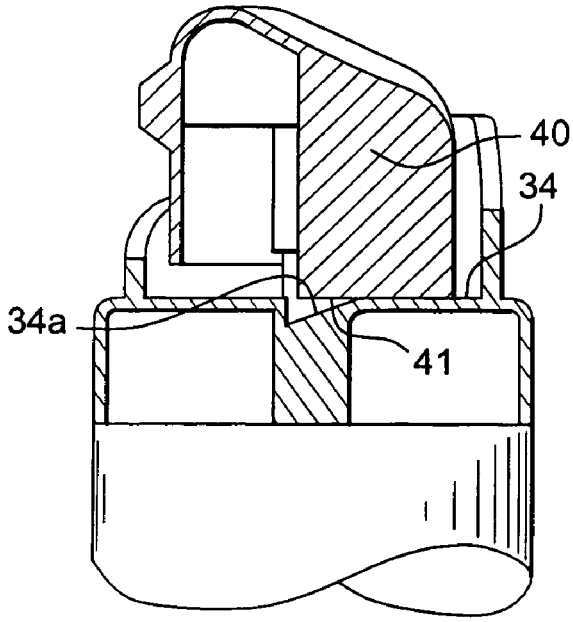

According to a variant shown in FIG. 8, a flap 40 can be provided with a free edge 41 forming a totally straight stop without rounding. In this example, a transverse wall 34 of the fixing element 30 can be used which has a portion 34*a*, such as a recessed portion, slightly inclined forwards facing the flap so as to allow swiveling of the dispensing device towards the front.

To avoid the lateral swinging (e.g., about an axis transverse to the Y axis) of the dispensing device 20 relative to the fixing element, advantageously a guide arrangement 50 is provided, which is configured to allow swiveling of the dispensing device only about axis Y. According to the example shown, the guide 50 includes a guide rail or slot. The rail or slot arrangement has a sufficient height to be able to receive the opposite flap 40. In particular, the free end 41 of the flap is engaged between the two walls of the rail or slot 50 in the rest position. Alternate guide arrangements formed of one or more guide elements could alternately be used.

The guide 50 allows proper positioning of the dispensing device relative to the actuator rods during actuation so as to move the two rods in the same way. Thus, the two products can be dispensed in the same proportions on each actuation.

By way of example, the packaging assembly can also include a cover 60 to protect the dispensing device 20. The cover 60 is held by clamping on the fixing element 30, in particular on the peripheral shoulder 39.

Figure 9:
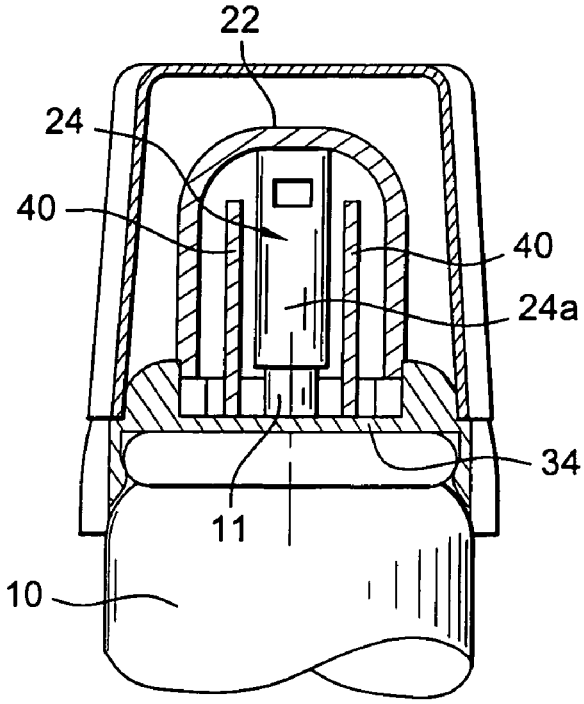
FIGS. 8 and 9 are variants of the assembly according to the invention.

In the example which has just been described, two containers are provided. However, the dispensing device 20 can also be used on a single container as shown in FIG. 9. The arrangement or element(s) preventing depression of the actuator rod and allowing its swiveling in a single direction only can be provided on one side of the valve rod or, as shown at 40 in FIG. 9, on both sides of the valve rod. This example does not include a guide to prevent lateral swinging of the device. Because the device has only one container, it is less susceptible to lateral movement. In addition, since a flap is provided on each side of the valve rod, the two flaps themselves prevent or minimize lateral swinging.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A product packaging and dispensing assembly comprising:

at least one container containing a product, wherein the container is fitted with a dispensing element comprising an actuator rod having a longitudinal axis X;

a dispensing device which is movable relative to the container in order to actuate the dispensing element and allow the output of the product through at least one dispensing opening;

an arrangement which limits displacement of the dispensing device, the arrangement comprising at least one flap, and a transverse surface which is transverse to the longitudinal axis, wherein the at least one flap and the transverse surface are configured such that on depression or force of the dispensing device along the longitudinal axis movement of the actuator rod along the longitudinal axis is limited, and wherein said arrangement is also configured such that the dispensing device swivels the actuator rod in a first direction about an axis Y from a rest position of the rod and the dispensing device is limited from swiveling the actuator rod about axis Y in a direction opposite the first direction from the rest position;

wherein the assembly includes a fixing element mounted on said container, and wherein said dispensing device is mounted on said fixing element;

wherein said transverse surface is provided on said fixing element, and wherein said at least one flap rocks upon said fixing element to swivel the actuator rod; and wherein the assembly includes two containers each having a respective actuator rod, and wherein said fixing element is mounted to both of said containers.

2. An assembly according to claim 1, wherein the flap extends parallel to the longitudinal axis X.

3. An assembly according to either of claim 1, wherein the flap extends inside the dispensing device from an upper surface to a free edge forming a stop.

4. An assembly according to claim 3, wherein the free edge of the flap comprises a straight portion coming to rest on the transverse surface, and a rounded portion, wherein at least part of the rounded portion is located at a distance from the transverse surface measured along the longitudinal axis X when the actuator rod is not being actuated.

5. An assembly according to claim 1, further including a guide configured so as to allow the swiveling of the dispensing device only about axis Y.

6. An assembly according to claim 5, wherein the guide comprises a rail situated to oppose the flap.

7. An assembly according to claim 1, wherein the fixing element comprises an assembly skirt which is mounted onto the container.

8. An assembly according to claim 1, wherein the dispensing device comprises at least one sleeve which is engageable on the actuator rod of the container.

9. An assembly according to claim 1, wherein the dispensing device is arranged to channel products separately to two dispensing openings.

10. An assembly according to claim 9, wherein the dispensing device comprises two separate channels to guide the product from each container to each dispensing opening.

11. An assembly according to claim 1, wherein the dispensing device is arranged to mix products before the products exit the dispensing opening.

12. An assembly according to claim 1, wherein the assembly comprises a removable cover which covers and protects the dispensing device.

13. An assembly according to claim 1, wherein the containers are pressurized.

14. An assembly according to claim 13, wherein the dispensing element comprises a valve.

15. An assembly according to claim 1, wherein the container contains a cosmetic product.

16. An assembly according to claim 1, wherein the container contains a hair coloring product.

17. An assembly according to claim 1, wherein one of the containers contains a dye and the other container contains an oxidizing agent.

18. A product packaging and dispensing assembly comprising:

at least one container containing a product, wherein the container is fitted with a dispensing element comprising an actuator rod having a longitudinal axis X;

a dispensing device which is movable relative to the container in order to actuate the dispensing element and allow the output of the product through at least one dispensing opening;

an arrangement which limits displacement of the dispensing device, the arrangement comprising at least one flap, and a transverse surface which is transverse to the longitudinal axis, wherein the at least one flap and the transverse surface are configured such that on depression or force of the dispensing device along the longitudinal axis movement of the actuator rod along the longitudinal axis is limited, and wherein said arrangement is also configured such that the dispensing device swivels the actuator rod in a first direction about an axis Y from a rest position of the rod and the dispensing device is limited from swiveling the actuator rod about axis Y in a direction opposite the first direction from the rest position;

wherein the assembly further includes two walls defining a slot therebetween to form a guide, and wherein the flap comprises a further wall and having a free edge;

wherein the free edge of the flap is at least partially received in said guide; and wherein the dispensing device includes a shell, and wherein a pipe extends within an interior of said shell and over the actuator rod, and further wherein the flap extends within the interior of said shell at a location spaced from said pipe.

19. An assembly according to claim 18, wherein the assembly comprises a fixing element which assists mounting of the dispensing device on the container.

20. An assembly according to claim 18, wherein the assembly includes a fixing element mounted on said container, and wherein said dispensing device is mounted on said fixing element.

21. An assembly according to claim 20, wherein said dispensing device is at least partially coupled to said assembly by a connection between said dispensing device and said fixing element.

22. An assembly according to claim 18, wherein the assembly includes a pair of containers each having a respective actuator rod, and wherein the shell includes a pair of said pipes each engaging one of the actuator rods, and further wherein the flap is positioned between the pair of pipes.

23. A product packaging and dispensing assembly comprising:

at least one container containing a product, wherein the container is fitted with a dispensing element comprising an actuator rod having a longitudinal axis X;

a dispensing device which is movable relative to the container in order to actuate the dispensing element and allow the output of the product through at least one dispensing opening;

an arrangement which limits displacement of the dispensing device, the arrangement comprising at least one flap, and a transverse surface which is transverse to the longitudinal axis, wherein the at least one flap and the transverse surface are configured such that on depression or force of the dispensing device along the longitudinal axis movement of the actuator rod along the longitudinal axis is limited, and wherein said arrangement is also configured such that the dispensing device swivels the actuator rod in a first direction about an axis Y from a rest position of the rod and the dispensing device is limited from swiveling the actuator rod about axis Y in a direction opposite the first direction from the rest position;

wherein the assembly comprises a fixing element which assists mounting of the dispensing device on the container;

wherein the dispensing device includes a shell, and wherein the shell is coupled to the actuator rod at a location inside of said shell, and further wherein the flap extends within an interior of said shell at a location spaced from the location at which the shell is coupled to the actuator rod; and wherein the dispensing device comprises at least one hook element to hook upon the fixing element, and wherein said at least one hook projects from a bottom periphery of the shell.

24. An assembly according to claim 23, wherein the at least one hook element cooperates with at least one shaft so as to be able to pivot about the shaft and allow swiveling of the dispensing device about axis Y.

25. An assembly according to claim 24, wherein two hook elements are provided which cooperate respectively with two shafts, wherein the two hook elements and two shafts are respectively aligned along a line parallel to axis Y.

26. An assembly according to claim 23, wherein the fixing element includes a recessed portion and wherein part of said flap cooperates with said recessed portion such that said dispensing device rocks upon said fixing element.

27. An assembly according to claim 23, wherein the assembly includes two containers each having a respective actuator rod, and wherein said fixing element is mounted to both of said containers.

28. An assembly according to claim 27, wherein said flap is positioned between said actuator rods, wherein a guide extends from said transverse surface, and wherein said guide receives said flap.

29. A product packaging and dispensing assembly comprising:

at least one container containing a product, wherein the container is fitted with a dispensing element comprising an actuator rod having a longitudinal axis X;

a dispensing device which is movable relative to the container in order to actuate the dispensing element and allow the output of the product through at least one dispensing opening;

an arrangement which limits displacement of the dispensing device, the arrangement comprising at least one flap, and a transverse surface which is transverse to the longitudinal axis, wherein the at least one flap and the transverse surface are configured such that on depression or force of the dispensing device along the longitudinal axis movement of the actuator rod along the longitudinal axis is limited, and wherein said arrangement is also configured such that the dispensing device swivels the actuator rod in a first direction about an axis Y from a rest position of the rod and the dispensing device is limited from swiveling the actuator rod about axis Y in a direction opposite the first direction from the rest position;

wherein the assembly further includes two walls defining a slot therebetween to form a guide, and wherein the flap comprises a further wall and having a free edge;

wherein the free edge of the flap is at least partially received in said guide;

wherein the assembly includes a fixing element mounted on said container, and wherein said dispensing device is mounted on said fixing element; and wherein said dispensing device is at least partially coupled to said assembly by a connection between said dispensing device and said actuator rod.

30. A product packaging and dispensing assembly comprising:

at least one container containing a product, wherein the container is fitted with a dispensing element comprising an actuator rod having a longitudinal axis X;

a dispensing device which is movable relative to the container in order to actuate the dispensing element and allow the output of the product through at least one dispensing opening;

an arrangement which limits displacement of the dispensing device, the arrangement comprising at least one flap, and a transverse surface which is transverse to the longitudinal axis, wherein the at least one flap and the transverse surface are configured such that on depression or force of the dispensing device along the longitudinal axis movement of the actuator rod along the longitudinal axis is limited, and wherein said arrangement is also configured such that the dispensing device swivels the actuator rod in a first direction about an axis Y from a rest position of the rod and the dispensing device is limited from swiveling the actuator rod about axis Y in a direction opposite the first direction from the rest position;

wherein the assembly further includes two walls defining a slot therebetween to form a guide, and wherein the flap comprises a further wall and having a free edge;

wherein the free edge of the flap is at least partially received in said guide;

wherein the assembly includes a fixing element mounted on said container, and wherein said dispensing device is mounted on said fixing element; and wherein said transverse surface is provided on said fixing element, and wherein said at least one flap rocks upon said fixing element to swivel the actuator rod.

31. An assembly according to claim 30, wherein said at least one flap includes a rounded portion which rocks upon said transverse surface.

32. An assembly according to claim 30, wherein prevention of said swiveling in the direction opposite the first direction is at least partially provided by abutment of a portion of said flap with said transverse surface.

33. An assembly according to claim 30, wherein prevention of said swiveling in the direction opposite the first direction is at least partially provided by a shoulder provided on said fixing element.

34. An assembly according to claim 33, wherein said shoulder extends along only a portion of a periphery of said fixing element.

35. A product packaging and dispensing assembly comprising:

at least one container containing a product, wherein the container is fitted with a dispensing element comprising an actuator rod having a longitudinal axis X;

a dispensing device which is movable relative to the container in order to actuate the dispensing element and allow the output of the product through at least one dispensing opening;

an arrangement which limits displacement of the dispensing device, the arrangement comprising at least one flap, and a transverse surface which is transverse to the longitudinal axis, wherein the at least one flap and the transverse surface are configured such that on depression or force of the dispensing device along the longitudinal axis movement of the actuator rod along the longitudinal axis is limited, and wherein said arrangement is also configured such that the dispensing device swivels the actuator rod in a first direction about an axis Y from a rest position of the rod and the dispensing device is limited from swiveling the actuator rod about axis Y in a direction opposite the first direction from the rest position;

wherein the dispensing device includes a shell, and wherein the shell is coupled to the actuator rod at a location inside of said shell, and further wherein the flap extends within an interior of said shell at a location spaced from the location at which the shell is coupled to the actuator rod; and wherein the assembly further includes a fixing element which mounts the dispensing device to the container, and the fixing element includes a skirt mounted onto the container, and wherein the shell is pivotably mounted to the fixing element, and further wherein the fixing element includes said transverse surface.

36. An assembly according to claim 35, wherein the assembly includes a pair of containers each having a respective actuator rod, and wherein the shell includes a pair of pipes each engaging one of the actuator rods, and further wherein the flap is positioned between the pair of pipes.

37. An assembly according to claim 35, wherein the dispensing device includes at least one hook extending from a bottom periphery of said shell and which hooks onto the fixing element.

* * * * *